US006510791B1

(12) United States Patent
Hillebrand et al.

(10) Patent No.: US 6,510,791 B1
(45) Date of Patent: Jan. 28, 2003

(54) WEB-FED ROTARY PRESS

(75) Inventors: Bernd Anton Hillebrand, Bergrheinfeld (DE); Wolfgang Günter Ruckmann, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/856,500

(22) PCT Filed: Dec. 23, 1999

(86) PCT No.: PCT/DE99/04088

§ 371 (c)(1),
(2), (4) Date: Jun. 14, 2001

(87) PCT Pub. No.: WO00/40410

PCT Pub. Date: Jul. 13, 2000

(30) Foreign Application Priority Data

Dec. 30, 1998 (DE) ..... 198 60 540

(51) Int. Cl.[7] ..... B41F 5/04

(52) U.S. Cl. ..... 101/231; 101/179; 101/217; 101/229

(58) Field of Search ..... 101/217, 228, 101/221, 222, 230, 424.1, 231, 232, 271, 283, 179, 180, 181, 178, 219

(56) References Cited

U.S. PATENT DOCUMENTS

| | | | | | |
|---|---|---|---|---|---|
| 1,646,034 | A | * | 10/1927 | Mayer | 101/180 |
| 1,738,324 | A | * | 12/1929 | Scott | 101/180 |
| 2,400,966 | A | * | 5/1946 | Zuckerman | 101/180 |
| 4,325,301 | A | | 4/1982 | Grosshauser | |
| 4,393,772 | A | * | 7/1983 | Burger | 101/217 |
| 4,646,636 | A | | 3/1987 | Gertsch | |
| 5,483,886 | A | * | 1/1996 | Hauer | 101/180 |
| 5,749,567 | A | | 5/1998 | DeAngelis | |
| 5,782,182 | A | * | 7/1998 | Ruckmann et al. | 101/177 |
| 5,970,871 | A | * | 10/1999 | Andres | 101/180 |
| 6,058,844 | A | * | 5/2000 | Niemiec | 101/424.1 |
| 6,076,466 | A | * | 6/2000 | Siler et al. | 101/219 |
| 6,186,064 | B1 | * | 2/2001 | Dufour | 101/180 |
| 6,332,397 | B1 | * | 12/2001 | Bolza-Schunemann et al. | 101/183 |
| 6,363,848 | B1 | * | 4/2002 | Weschenfelder | 101/138 |
| 6,374,731 | B1 | * | 4/2002 | Walczak et al. | 101/142 |

FOREIGN PATENT DOCUMENTS

| | | |
|---|---|---|
| CH | 550 666 | 6/1974 |
| DE | 1 827 845 | 3/1961 |
| DE | 79 20 934 | 10/1979 |
| DE | 29 32 087 C2 | 2/1981 |
| DE | 29 32 087 A1 | 2/1981 |
| DE | 35 41 588 C2 | 6/1986 |
| DE | 44 08 027 A1 | 9/1995 |
| DE | 197 42 560 A1 | 1/1999 |
| EP | 0 644 048 A2 | 3/1995 |

* cited by examiner

*Primary Examiner*—Andrew H. Hirshfeld
*Assistant Examiner*—Dave A. Ghatt
(74) *Attorney, Agent, or Firm*—Jones, Tullar & Cooper, PC

(57) ABSTRACT

A multi-color, web-fed rotary printing press provides a shortened construction. A web passes vertically downwardly through a plurality of bridge printing units which are arranged one above the other. A lowermost one of these bridge printing units has a transfer cylinder that changes the path of web travel from a generally vertical direction to a generally horizontal direction in route to a downstream located device, such as a drying device.

14 Claims, 4 Drawing Sheets

WEB-FED ROTARY PRESS

FIELD OF THE INVENTION

The present invention relates to a web-fed rotary printing press. A plurality of bridge printing units each have two forme or plate cylinders and two transfer or blanket cylinders. The production travel of the material web through the printing units is generally vertical.

DESCRIPTION OF THE PRIOR ART

A multicolor web-fed rotary printing press is shown in DE 44 08 027 A1. The print units are arranged one behind the other in a so-called "I-construction".

DE 29 32 087 C2 discloses a bridge printing unit. A rubber blanket cylinder deflects a web of material from an approximately horizontal direction of travel into a vertical direction.

SUMMARY OF THE INVENTION

The object of the present invention is directed to providing a web-fed rotary printing press.

In accordance with the present invention, this object is attained by providing the web-fed rotary printing press with a plurality of bridge printing units, each having two forme or plate cylinders and two transfer or blanket cylinders. The web passes generally vertically from the uppermost bridge printing unit through the lowermost bridge printing unit.

The advantages which can be achieved by the present invention primarily reside in that the printing press has a shortened space requirement. After leaving the last printing location, the printed paper web is conducted on the shortest route to a further installation, for example to a drying device, which drying device is beneficially arranged on a first or lower level because of its weight.

Preferred embodiments of the present invention are represented in the accompanying drawing figures and will be described in greater detail in what follows.

Figure 1:
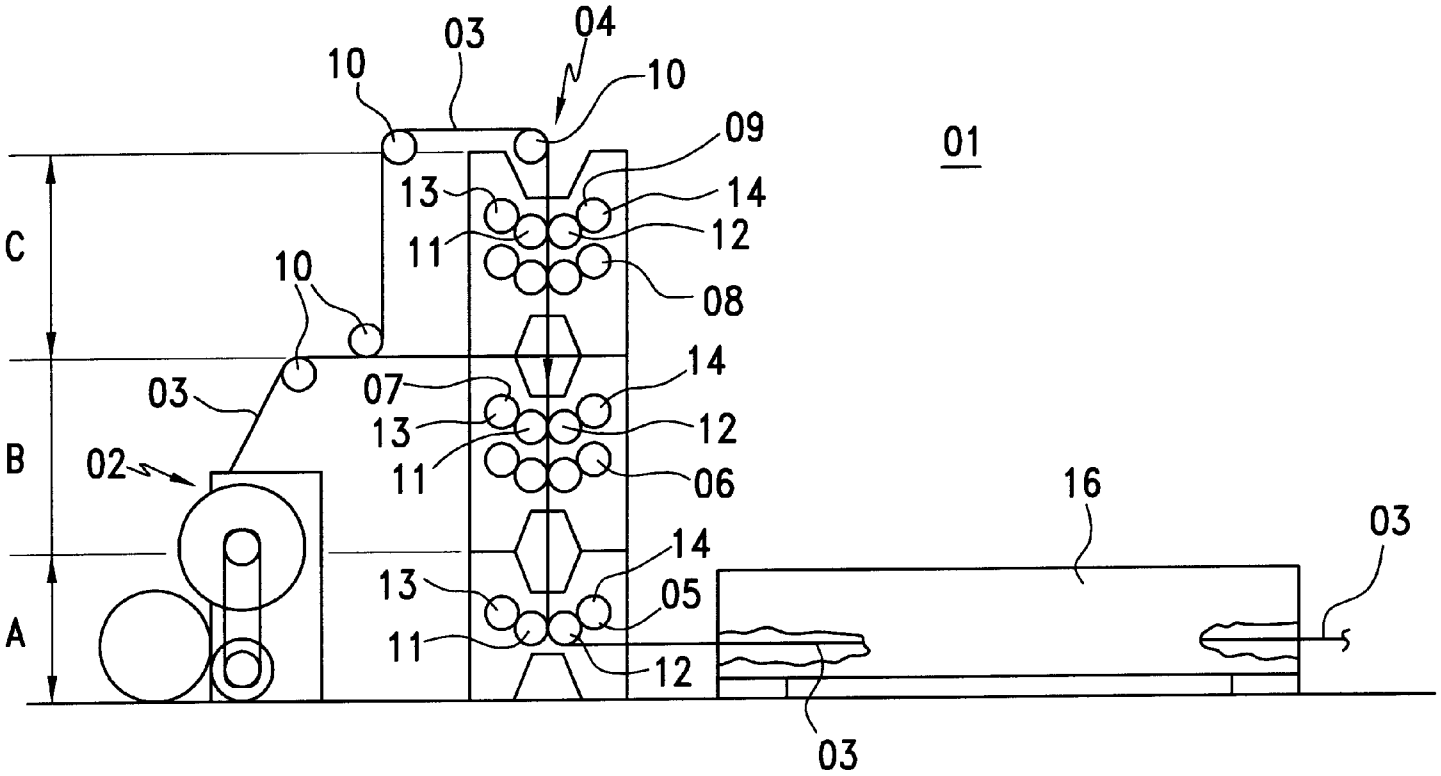
FIG. 1 shows a lateral view of a first preferred embodiment, in accordance with the present invention, of a printing press.

A multicolor web-fed rotary printing press 01 consists of a reel changer 02 for webs of material, for example paper webs 03, which are fed to a multiple printing unit 04. The multiple printing unit 04 depicted in FIG. 1 consists of a bridge printing unit 05 arranged on a lower level A, as well as of at least two bridge printing units 06, 07 arranged one above the other on a center level B, and of bridge printing units 08, 09 arranged on an uppermost level C.

Preferably at least four bridge printing units, such as bridge printing units 06, 07, are arranged above each other in the multiple printing unit 04.

In one preferred embodiment, it is also possible to arrange several bridge printing units, such as bridge printing units 06, 07, one above the other on the lower level A.

Each one of the bridge printing units 05 to 09 has two transfer cylinders, such as rubber blanket cylinders 11, 12, which act against each other, or against the paper web 03 that passes between them, and which cause a 1/1 print on both sides of the paper web 03. Respective forme cylinders

13, 14, each being, for example a plate cylinder provided with reference numerals at the bridge printing units 05, 07, 09, and an ink supply device, not specifically represented, for example for dry offset printing methods, are assigned to each rubber blanket cylinder 11, 12 of the bridge printing units 05 to 09 on the side of each blanket cylinder that is facing away from the paper web 03.

The paper web 03, which is coming from the reel changer 02, is initially conducted over paper guide rollers 10 to the uppermost bridge printing unit 09 and runs through it, as well as through the subsequent bridge printing units 08, 07, 06 in a generally downward direction toward the lowermost bridge printing units 05. In the process of passing through the plurality of bridge printing units 09, 08, 07, 06 and 05, the paper web 03 runs along, or follows a vertical or approximately vertical course from the uppermost bridge printing unit to the lowermost bridge printing unit.

One of the two rubber blanket cylinders 11, 12, for example the rubber blanket cylinder 12, of the lowermost bridge printing unit 05, is used as a deflection cylinder for the paper web 03. This lowermost rubber blanket cylinder 12 deflects the paper web 03 out of the vertical direction and into a horizontal, or nearly horizontal direction, to a downstream-connected installation 16.

Figure 2:
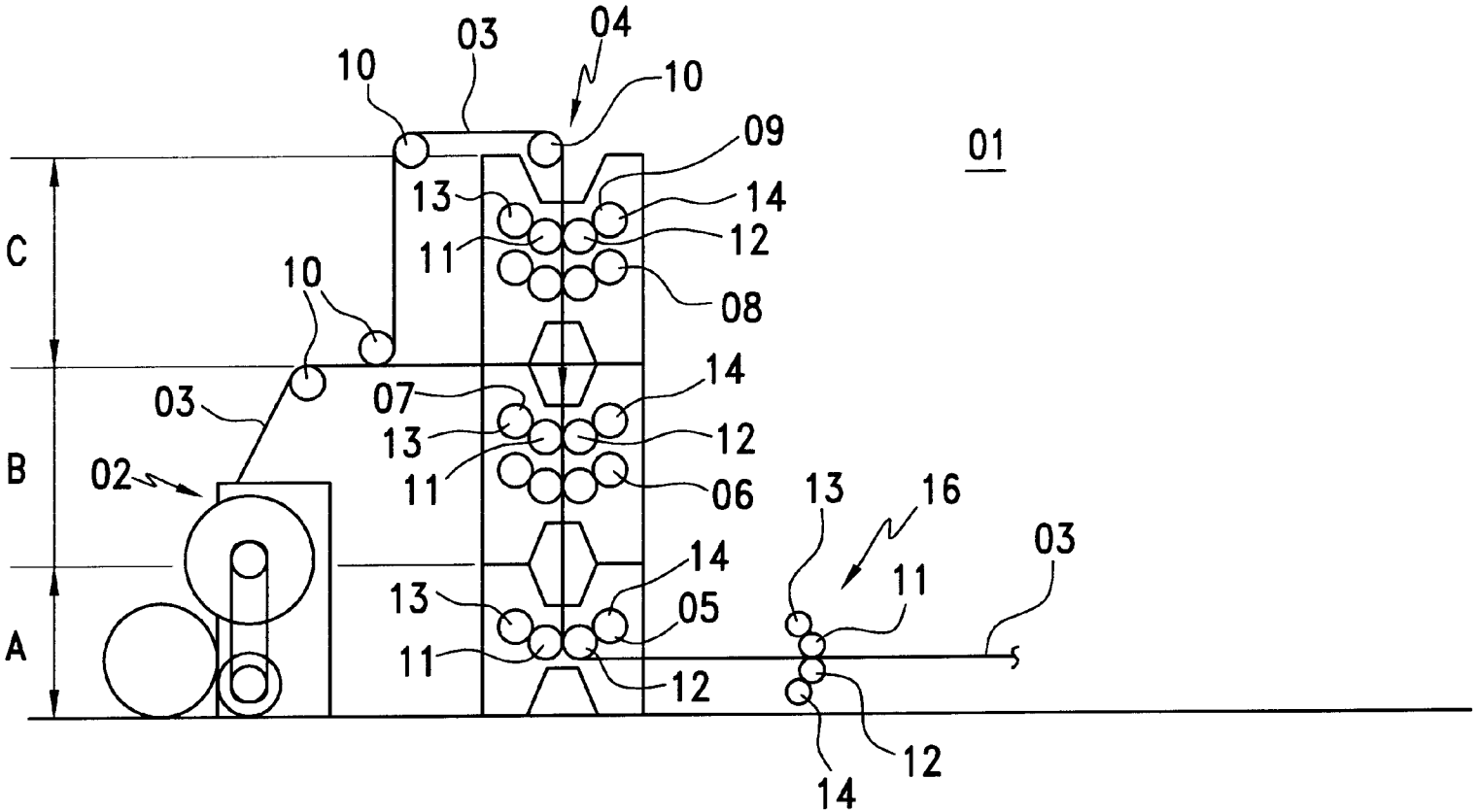
FIG. 2 shows a second preferred embodiment.

In accordance with a second preferred embodiment, as seen in FIG. 2, the downstream-connected installation 16 can be structured to include its own pair of rubber blanket cylinders 11, 12, which are arranged one above the other and which additional rubber blanket cylinders 11, 12 can be brought into contact with each other, and to each of which a forme cylinder 13, 14 with its associated inking system is assigned. This results in the provision of a so-called "I-printing unit".

Figure 3:
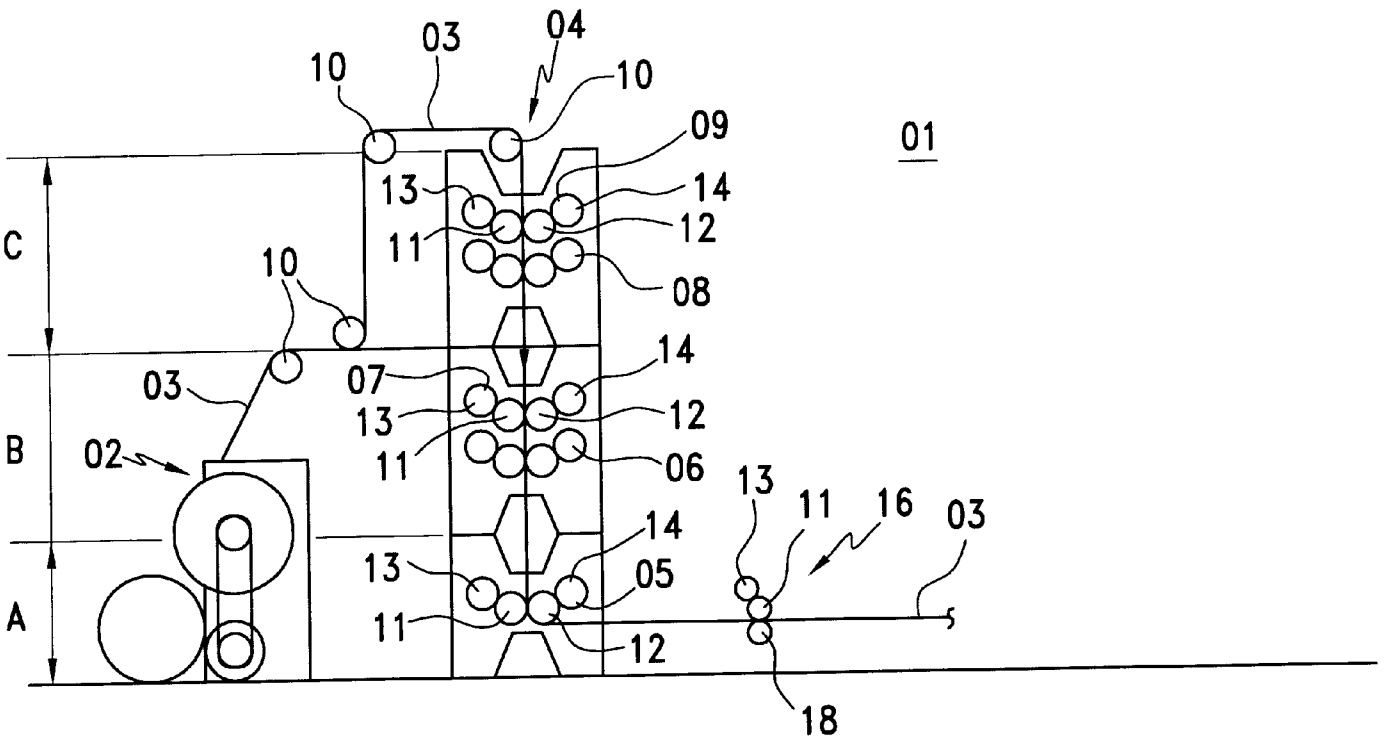
FIG. 3 shows a third preferred embodiment.

In accordance with a third preferred embodiment, as seen in FIG. 3, the downstream-connected installation 16 can consist of a printing unit with at least one rubber blanket cylinder 11 or 12 for transferring a print image, and of a counter-pressure cylinder 18 arranged above or below it, which counter-pressure cylinder 18 can be brought into contact with the rubber blanket cylinder 11 or 12.

Figure 4:
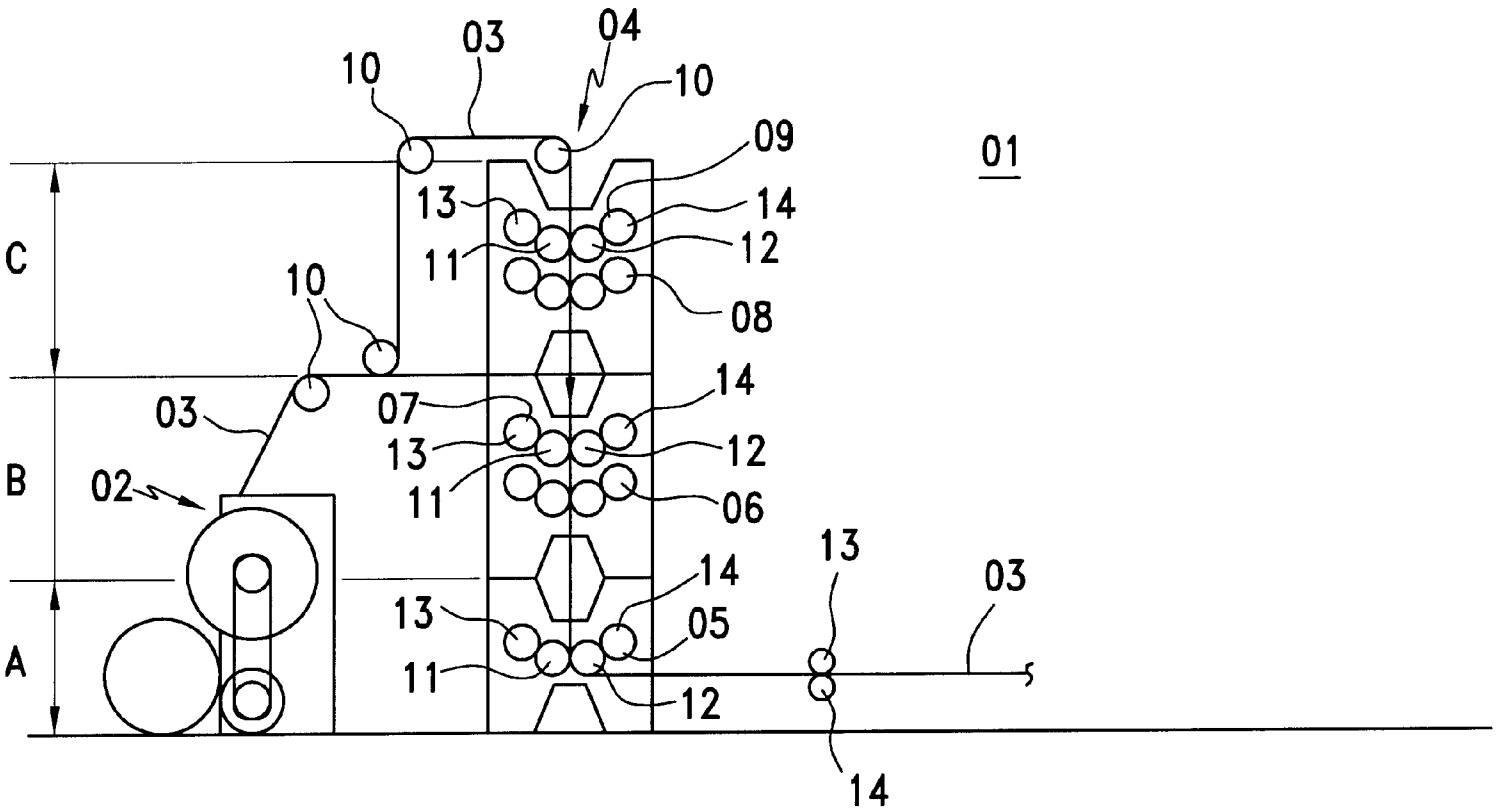
FIG. 4 shows a fourth preferred embodiment of a printing press in accordance with the present invention.

In accordance with a fourth preferred embodiment as seen in FIG. 4, a forme cylinder 13 or 14 can work together with the counter-pressure cylinder 18, instead of the rubber blanket cylinder 11 or 12 to transfer a print image from the forme cylinder 13 to the paper web 03 which passes between the forme cylinder 13 and the counter-pressure cylinder 18.

It is to be understood that at least one inking unit is provided in each of the last two described preferred embodiments.

A drying device can be connected downstream of the lowermost bridge printing unit 05, in addition to as well as of one of the previously mentioned, downstream-connected printing unit installations 16.

It is also possible for the downstream-connected installation 16 to be embodied solely as a drying device.

While preferred embodiments of a web-fed rotary printing press in accordance with the present invention have been set forth fully and completely hereinabove, it will be apparent to one of skill in the art that a number of changes in, for example the sizes of the various cylinders, the drives for the cylinders and rollers and the like could be made without departing from the true spirit and scope of the present invention which is accordingly to be limited only by the following claims.

What is claimed is:

1. A web-fed rotary printing press comprising:

a plurality of bridge printing units, said plurality of bridge printing units including at least an uppermost bridge printing unit and a lowermost bridge printing unit, said plurality of bridge printing units defining a generally vertical course of travel of a web traveling through said plurality of bridge printing units in a production direction extending from said uppermost bridge printing unit to said lowermost bridge printing unit, first and second forme cylinders and first and second cooperating transfer cylinders in each of said plurality of bridge printing units, said first and second cooperating transfer cylinders in each of said plurality of bridge printing units contacting opposite sides of a web traveling through said plurality of bridge printing units and between said first and second cooperating transfer cylinders in each of said plurality of bridge printing units to print the opposite sides of the web; and one of said first and second cooperating transfer cylinders in said lowermost one of said plurality of bridge printing units being a deflection cylinder, said deflection cylinder changing a direction of travel of the web from said generally vertical course of travel to a generally horizontal course of travel to a downstream, in a direction of web travel, located web receiving installation.

2. The web-fed rotary printing press of claim 1 wherein said downstream located web receiving installation is arranged adjacent to said lowermost one of said plurality of bridge printing units.

3. The web-fed rotary printing press of claim 2 wherein said downstream located web receiving installation is a double printing units with cooperating transfer cylinders arranged one above the other and forming an I-printing unit.

4. The web-fed rotary printing press of claim 3 further including a drying device located after, in a direction of web travel, said I-printing unit.

5. The web-fed rotary printing unit of claim 2 wherein said downstream located web receiving installation is a printing unit with a forme cylinder and a transfer cylinder arranged above and engaging one another and with a counter-pressure cylinder, said transfer cylinder being engageable with said counter-pressure cylinder.

6. The web-fed rotary printing press of claim 2 wherein said downstream located web receiving installation is a printing unit with a forme cylinder and with a counter-pressure cylinder arranged one above the other, said forme cylinder being engageable with said counter-pressure cylinder.

7. The web-fed rotary printing press of claim 2 wherein said downstream located web receiving installation is a drying device.

8. The web-fed rotary printing press of claim 2 further including a drying device located after, in a direction of web travel, said plurality of bridge printing units.

9. The web-fed rotary printing press of claim 1 wherein said downstream located web receiving installation is a double printing unit with cooperating transfer cylinders arranged one above the other and forming an I-printing unit.

10. The web-fed rotary printing press of claim 9 further including a drying device located after, in a direction of web travel, said I-printing unit.

11. The web-fed rotary printing unit of claim 1 wherein said downstream located web receiving installation is a printing unit with a forme cylinder and a transfer cylinder arranged above, and engaging one another and with a counter-pressure cylinder, said transfer cylinder being engageable with said counter-pressure cylinder.

12. The web-fed rotary printing press of claim 1 wherein said downstream located web receiving installation is a printing unit with a forme cylinder and with a counter-pressure cylinder arranged one above the other, said forme cylinder being engageable with said counter-pressure cylinder.

13. The web-fed rotary printing press of claim 1 wherein said downstream located web receiving installation is a drying device.

14. The web-fed rotary printing press of claim 1 further including a drying device located after, in a direction of web travel, said plurality of bridge printing units.

* * * * *